US006265694B1

(12) United States Patent
Pirwitz

(10) Patent No.: US 6,265,694 B1
(45) Date of Patent: Jul. 24, 2001

(54) SHEET STRIPPING METHOD AND APPARATUS AND A FUSING MECHANISM INCLUDING SAME

(75) Inventor: Robert G. Pirwitz, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/693,166

(22) Filed: Oct. 23, 2000

(51) Int. Cl.[7] ..... B65H 29/54; G03G 15/20
(52) U.S. Cl. ..... 219/216; 399/323; 271/307
(58) Field of Search ..... 219/216, 469; 399/323; 271/307, 311

(56) References Cited

U.S. PATENT DOCUMENTS 4,920,250 * 4/1990 Urban ..... 219/216
5,350,896 * 9/1994 Amico et al. ..... 219/216

* cited by examiner

*Primary Examiner*—Joseph Pelham
(74) *Attorney, Agent, or Firm*—Tallam I. Nguti

(57) ABSTRACT

A sheet stripping method and apparatus are provided for stripping a sheet coming out of a process nip, from a surface of a moving roller forming part of the process nip. The sheet stripping method employing the apparatus includes the steps of (i) first contacting with a central portion of a stripping device, a central section of a lead edge of the sheet coming out of the process nip; and (ii) next contacting with a first edge portion and a second edge portion of the stripping device, a first edge section and a second and opposite edge section of the lead edge of the sheet coming out of the process nip, thereby preventing damage to the sheet taking advantage of a difference between self-stripping tendencies of the central and edge sections of the lead edge of a sheet coming out of a process nip.

8 Claims, 3 Drawing Sheets

SHEET STRIPPING METHOD AND APPARATUS AND A FUSING MECHANISM INCLUDING SAME

BACKGROUND OF THE INVENTION

This invention relates generally to electrostatographic reproduction machines, and particularly to a sheet stripping method and apparatus, and a fusing mechanism including same, for reliably stripping sheets from a fusing mechanism of a reproduction machine without sheet lead edge damage.

In a typical electrostatographic reproduction process machine, a photoconductive member is charged to a substantially uniform potential so as to sensitize the surface thereof. The charged portion of the photoconductive member is imagewise exposed in order to selectively dissipate charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated at a thermal fusing apparatus at a desired operating temperature so as to fuse and permanently affix the powder image to the copy sheet.

In order to fuse and fix the powder toner particles onto a copy sheet or support member permanently as above, it is necessary for the thermal fusing apparatus to elevate the temperature of the toner images to a point at which constituents of the toner particles coalesce and become tacky. This action causes the toner to flow to some extent onto the fibers or pores of the copy sheet or support member or otherwise upon the surface thereof. Thereafter, as the toner cools, solidification occurs causing the toner to be bonded firmly to the copy sheet or support member.

One approach to thermal fusing of toner images onto the supporting substrate is illustrated for example in U.S. Pat. Nos. 5,350,896, and 4,920,250. This approach involves passing the substrate with the unfused toner images thereon into nip contact between a pair of opposed fusing members, usually rollers but can be a roller and a belt, at least one of which is heated, and its temperature controlled at a desired high operating or fusing temperature level of about 350 degrees Fahrenheit. After such fusing, the substrate or sheet must then be stripped by a stripper from the heated fuser roller.

Conventional strippers typically come as individual fingers which tend to be flimsy or undesirably tear into and wear the fuser roll surface, or are designed with a uniform geometric shape across the width of the paper path. Unfortunately, it has been found that in an 80° F. and 80% RH environment, a large number of dog eared copies are undesirably produced in high volume machines. Dog ears are defined as a severe deformation of the lead edge corner of a copy, but not necessarily folded over.

There is therefore a need for a sheet stripping method and apparatus, and a fusing mechanism including same, that can relaibly strip sheets from a fusing mechanism of a reproduction machine without sheet lead edge damage.

SUMMARY OF THE INVENTION

In accordance with one aspect of the present invention, there is provided a sheet stripping method and apparatus are provided for stripping a sheet coming out of a process nip, from a surface of a moving roller forming part of the process nip. The sheet stripping method employing the apparatus includes the steps of (i) first contacting with a central portion of a stripping device, a central section of a lead edge of the sheet coming out of the process nip; and (ii) next contacting with a first edge portion and a second edge portion of the stripping device, a first edge section and a second and opposite edge section of the lead edge of the sheet coming out of the process nip, thereby preventing damage to the sheet taking advantage of a difference between self-stripping tendencies of the central and edge sections of the lead edge of a sheet coming out of a process nip.

BRIEF DESCRIPTION OF THE DRAWINGS

In the detailed description of the present invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
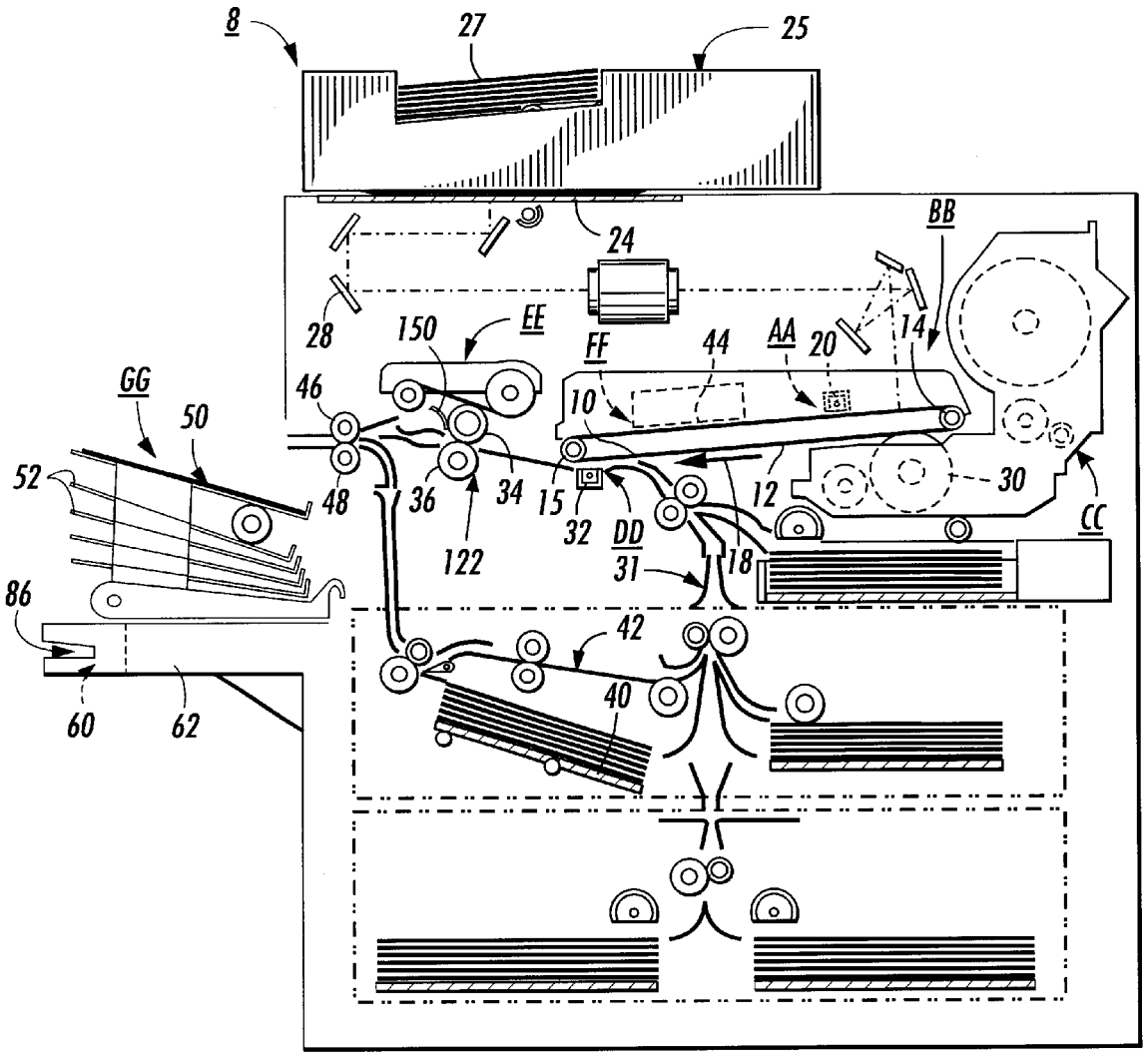
FIG. 1 is a vertical schematic of an exemplary electrostatographic reproduction machine utilizing the sheet stripping method and apparatus of the present invention.

Referring first to FIG. 1, an exemplary electrostatographic reproduction machine 8 according to the present invention is illustrated. As shown, the machine 8 has conventional imaging processing stations associated therewith, including a charging station AA, an imaging/exposing station BB, a development station CC, a transfer station DD, fusing station EE including an exemplary fusing apparatus in accordance with the present invention (to be described in detail below), a cleaning station FF, and a finishing station shown generally as GG.

As shown, the machine 8 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 8 can be briefly described as follows. Initially, the photoconductive belt 10 is charged at the charging station AA by a corona generating device 20. The charged portion of the belt is then transported by action of the drive roller 14 to the imaging/exposing station BB where a latent image is formed on the belt 10 corresponding to the image on a document positioned on a platen 24 via the light lens imaging system 28 of the imaging/exposing station BB. It will also be understood that the light lens imaging system can easily be changed to an input/output scanning terminal or an output scanning terminal driven by a data input signal to likewise image the belt 10. As is also well known, the document on the platen 24 can be placed there manually, or it can be fed there automatically by an automatic document handler device 25 that includes a multiple document sheet holding tray 27.

The portion of the belt 10 bearing the latent image is then transported to the development station CC where the latent image is developed by electrically charged toner material from a magnetic developer roller 30 of the developer station CC. The developed image on the belt is then transported to the transfer station DD where the toner image is transferred to a copy sheet fed by a copy sheet handling system 31. In this case, a corona generating device 32 is provided for charging the copy sheet so as to attract the charged toner image from the photoconductive belt 10 to the copy sheet. The copy sheet 44 with the transferred image thereon is then directed to the fuser station shown generally as EE.

Fuser station EE includes a fuser or fusing apparatus, shown for example as a roller type fusing apparatus 122 in accordance with the present invention. The fusing apparatus operates to heat, fuse and fix the toner image onto the copy sheet 44. The copy sheet then, as is well known, then may be selectively transported to the finishing area GG, or along a selectable duplex path 42, to a duplex tray 40.

Meanwhile, the portion of the belt 10 from which the developed image was transferred is then advanced to the cleaning station FF where residual toner and charge on the belt are removed by a cleaning device such as a blade 43, and a discharge lamp (not shown) in order to prepare the portion for a subsequent imaging cycle.

When not doing duplex imaging, or at the end of such duplex imaging, copy sheets upon finally leaving the fusing rolls 34, 36, are passed to finishing area input rolls 46 and 48. From the input rolls 46, 48, the copy sheets are fed, for example, individually to an output tray (not shown) or to a bin sorter apparatus 50 where the sheets can be arranged in a collated unstapled set within the tray or within each bin 52 of a bin sorter apparatus. The bin sorter apparatus 50 can comprise any number of bins 52, which as are well known, can be designed to nest, as well as to indexably cycle past a fixed loading point for sheets. A machine user making such set of copy sheets on the reproduction machine 8 can thus manually remove each such set at a time, and insert a corner or edge of the set into a convenience stapler assembly 60 for convenient stapling. As shown, the convenient stapler assembly 60 is built into a portion 62 of the frame of the machine 8, and at a location conveniently close to the bin sorter apparatus or output tray.

Figure 2:
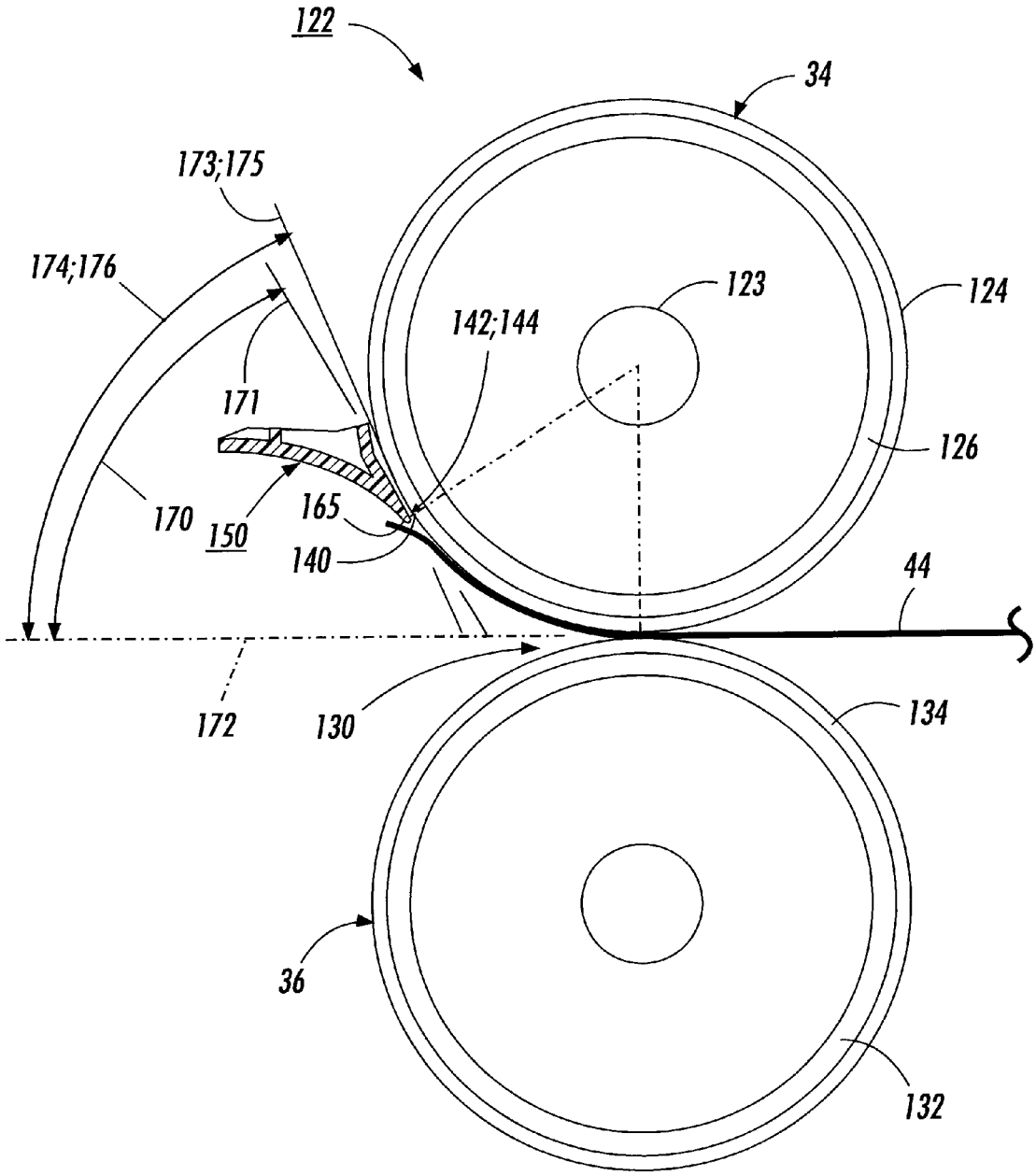
FIG. 2 is vertical schematic of the fusing mechanism of the machine of FIG. 1, illustrating the sheet stripping apparatus of the present invention.
Figure 3:
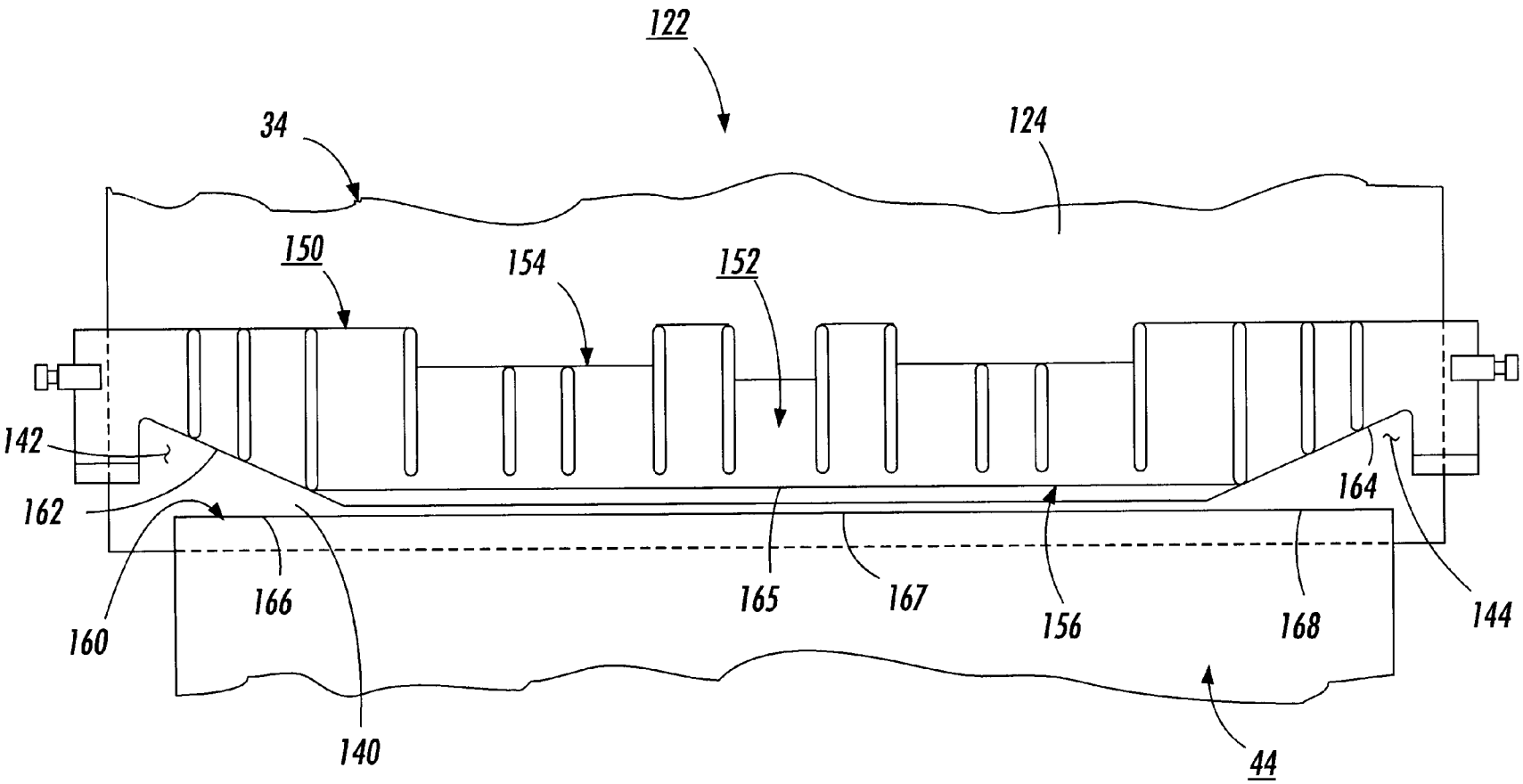
FIG. 3 is an illustration of the sheet stripping apparatus of the present invention.

Referring now to FIGS. 1–3, the fusing apparatus of the present invention may comprise a roller type fusing apparatus 122 that includes a heating member 123 in the form of a heated fuser roller or roll 34. The roller 34 as shown has a deformable elastomeric, such as a fluorocarbon, fusing surface 124 that is formed over a suitable base member 126. Base 126 is preferably a hollow cylinder or core that is fabricated from any suitable metal such as aluminum, anodized aluminum, steel, nickel, copper, or the like.

The roller type fusing apparatus 122 also includes a backup or pressure roller or roll 36 which cooperates with the fuser roll 34 to form a nip or contact arc 130 through which the copy sheet or substrate 44 is passed such that toner images thereon contact the surface 124 of fuser roll 34. As shown in FIG. 2, the backup or pressure roll 36 preferably has a rigid core 132 with a thick layer of silicone rubber, and an outer surface layer 134 consisting, for example, of a copolymer perfluoroalkyl perfluorovinyl ether with tetrafluroethylene (PFA).

The sheet stripping apparatus or copy stripping guide of the present invention is shown generally as 150. As illustrated it has a non-uniform cross-sectional geometry across the paper path for preventing dog eared copies, as well as eliminating the need for stripper fingers. Its non-uniform cross-sectional geometry across the paper path offers a distinct advantage over conventional stripper devices in that it does not require or use stripper fingers. Stripper fingers typically and undesirably add cost, complications, jam clearance problems, and fuser roll wear and tear.

The sheet stripping apparatus 150 of the present invention is baffle-like and preferably is a one piece molded plastic part, and is mounted at a point 140 in the sheet path so that it does not contact the fusing surface 124 of the fuser roll 34. As shown (FIG. 2), the stripping apparatus 150 is located at a position 140 that takes advantage of the self-stripping characteristics of the fusing system. It has been found after thorough video analysis of sheets exiting a process nip such as a fusing nip 130, that the corners or edge portions of the lead edge of sheets self-strip off the fusing surface of the fuser roll after or later than, the center or central portion of the lead edge. This is particularly the case in an 80° F. and 80% RH environment. The position 140 is thus selected to lie just after the central portion of the lead edge of the sheet has so started to self strip even when the corners of such lead edge are still on the fusing surface 124. As such, the stripping apparatus does not have to contact and scrape the fusing surface 124 in order to engage and pry the lead edge of the sheet from it. Note that once the central portion of the lead edge has been engaged as above, the rest of the lead edge, including its corners, will easily be lifted, and without contacting the surface 124, from the fuser roll.

To effect this, the stripping edge of the stripping apparatus 150 has a different geometric shape at its center portion of the stripping apparatus 150, as compared to the geometry at the ends. As will be described in detail below, the stripping edge of the apparatus 150 allows for the late self-stripping of the corners of an oncoming sheet by delaying the point at which such corners come into contact with it. The result is a non-uniform geometry across the width of the stripping apparatus 150.

Specifically, the sheet stripping apparatus 150 is comprised of an elongate member 152 having a rear edge 154, and an elongate front edge 156 for contacting and stripping (from a surface, such as 124, of a moving roller 34), a lead edge 160 of a sheet 44 coming out of a process or fusing nip 130 formed in part by the moving roller. The elongate front edge 156 has a central portion 165 that is suitable for contacting and stripping a central section 167 of the lead edge 160 of the sheet 44 as the sheet exits the process or fusing nip 130. The elongate front edge 156 also has a first edge portion 162 and a second edge portion 164 that are each suitable for contacting and stripping a first edge section 166 and a second edge section 168 of the lead edge 160 of the sheet 44. As shown, FIG. 3, the first edge portion 162, the second edge portion 164 (elongate front edge 156) are each recessed, in a front-to-rear direction, relative to the central portion 165. Thus, each of the first edge portion 162 and the second edge portion 164 is declined rearwardly from the central portion 165. As such, each will contact and strip the first edge section 166, and the second edge section 168 of the lead edge 160 of the sheet at a later time, subsequently to the central portion 165 of the elongate front edge 156 contacting and stripping the central section 167 of the lead edge 160 of the sheet 44.

As shown FIG. 2, the central portion 165 of the elongate front edge 156 is located at the first point 140, spaced a first angle 170 formed by a tangent 171 through the point 140 and a bisectrix 172 through the fusing nip 130. Point 140 as such is where the central section 167 of the lead edge 160 of the sheet 44 has already started to self-strip from the surface of the moving roller 34. The first edge portion 162 and the second edge portion 164 of the elongate front edge 156 are each located at a second point 142 and at a third point 144, respectively, spaced a second angle 174 and a third angle 176, each formed by a tangent 173,175 through the points 142,144 and the bisectrix 172. Points 142 and 144 as such are where the first edge section 166 and the second and opposite edge section 168 of the lead edge 160 of the sheet 44 belatedly each begin to self-strip from the surface of the moving roller 34. As shown, the second angle 174 and the third angle 176 are equal and each greater than the first angle 170.

Thus the sheet stripping method of the present invention for stripping from a surface of a moving roller forming part of a process nip, a sheet coming out of the process nip, includes the steps of (i) first contacting with a central portion of a stripping device, a central section of a lead edge of the sheet coming out of the process nip; and (ii) next contacting with a first edge portion and a second edge portion of the stripping device, a first edge section and a second and opposite edge section of the lead edge of the sheet coming out of the process nip, thereby preventing damage to the sheet taking advantage of a difference between self-stripping tendencies of the central and edge sections of the lead edge of a sheet coming out of a process nip.

As can be seen, there has been provided in accordance with present invention, a sheet stripping method and apparatus are provided for stripping a sheet coming out of a process nip, from a surface of a moving roller forming part of the process nip. The sheet stripping method employing the apparatus includes the steps of (i) first contacting with a central portion of a stripping device, a central section of a lead edge of the sheet coming out of the process nip; and (ii) next contacting with a first edge portion and a second edge portion of the stripping device, a first edge section and a second and opposite edge section of the lead edge of the sheet coming out of the process nip, thereby preventing damage to the sheet taking advantage of a difference between self-stripping tendencies of the central and edge sections of the lead edge of a sheet coming out of a process nip.

While the invention has been described with reference to particular preferred embodiments, the invention is not limited to the specific examples shown, and other embodiments and modifications can be made by those skilled in the art without departing from the spirit and scope of the invention and claims.

What is claimed is:

1. A sheet stripping method for stripping a sheet coming out of a process nip, from a surface of a moving roller forming part of the process nip, the sheet stripping method comprising the steps of:

(a) first contacting with a central portion of a stripping device, a central section of a lead edge of the sheet coming out of the process nip; and;

(b) next contacting with a first edge portion and a second edge portion of the stripping device, a first edge section and a second and opposite edge section of the lead edge of the sheet coming out of the process nip, thereby preventing damage to the sheet taking advantage of a difference between self-stripping tendencies of the central and edge sections of the lead edge of a sheet coming out of a process nip.

2. A sheet stripping apparatus comprising:

(a) an elongate member having an elongate rear edge and an elongate front edge for contacting and stripping from a surface of a moving roller, a lead edge of a sheet coming out of a process nip formed in part by the moving roller;

(b) a central portion of said elongate front edge for contacting and stripping a central section of the lead edge of the sheet coming out of the process nip; and (c) a first edge portion and a second edge portion of said elongate front edge for contacting and stripping a first edge section and a second edge section of the lead edge of the sheet, said first edge portion, said second edge portion each recessed in a front to rear direction relative to said central portion for contacting and stripping the first edge section, the second edge section of the lead edge of the sheet on the surface of the moving roller, subsequently to said central portion of said elongate front edge contacting and stripping the central section of the lead edge of the sheet.

3. The sheet stripping apparatus of claim 2, wherein said central portion of said elongate front edge is located at a first point, spaced a first angle formed by a tangent through said first point and a bisectrix through the process nip, and where the central section of the lead edge of the sheet begins tending to self-strip from said surface of the moving roller.

4. The sheet stripping apparatus of claim 3, wherein said first edge portion and said second edge portion of said first elongate edge are each located at a second point and at a third point respectively, spaced a second angle and a third angle each formed by a tangent through said second point and said third point, and a bisectrix through the process nip, and where the first edge section and the second and opposite edge section of the lead edge of the sheet each begin tending to self-strip from said surface of the moving roller.

5. The sheet stripping apparatus of claim 4, wherein said second angle and said third angle are each greater than said first angle.

6. The sheet stripping apparatus of claim 4, wherein said third angle is equal to said second angle.

7. The sheet stripping apparatus of claim 6, wherein each of said first edge portion and said second edge portion is declined rearwardly from said central portion.

8. A fusing apparatus comprising:

(a) a moveable pressure member;

(b) a heat source for heating a fusing surface;

(c) a moveable fuser roller having a fusing surface in heating relationship with said heat source, said fusing surface forming a fusing nip with said moveable pressure member; and (d) a sheet stripping apparatus for contacting and stripping a fused sheet from said fusing surface, the sheet stripping apparatus including:

(i) an elongate member having an elongate rear edge and an elongate front edge for contacting and stripping, from said fusing, a lead edge of a sheet coming out of said fusing nip;

(ii) a central portion of said elongate front edge for contacting and stripping a central section of the lead edge of the sheet coming out of said fusing nip; and (iii) a first edge portion and a second edge portion of said elongate front edge for contacting and stripping a first edge section and a second edge section of the lead edge of the sheet, said first edge portion, and said second edge portion each being recessed in a front to rear direction relative to said central portion, for contacting and stripping the first edge section and the second edge section of the lead edge of the sheet on said fusing surface, subsequently to said central portion of said elongate front edge contacting and stripping the central section of the lead edge of the sheet.

* * * * *